United States Patent [19]

Arzounian

[11] Patent Number: 4,519,604

[45] Date of Patent: May 28, 1985

[54] EXERCISE MACHINE

[76] Inventor: Raymond Arzounian, 4332 Howland St., Philadelphia, Pa. 19124

[21] Appl. No.: 518,492

[22] Filed: Jul. 29, 1983

[51] Int. Cl.[3] ..... A63B 21/00

[52] U.S. Cl. ..... 272/73; 272/132; 272/134; 272/144; 128/25 R; 128/25 B

[58] Field of Search ..... 272/73, 134, 72, 131, 272/144, 132; 128/25 R, 25 B

[56] References Cited

U.S. PATENT DOCUMENTS

| | | | |
|---|---|---|---|
| 2,255,864 | 9/1941 | Stephens | 272/73 |
| 2,512,911 | 6/1950 | Benice | 272/79 |
| 2,673,088 | 3/1954 | Wentz | 272/73 |
| 3,112,108 | 11/1963 | Hanke | 272/72 |
| 3,189,344 | 6/1965 | Swarts | 272/58 |

FOREIGN PATENT DOCUMENTS

| | | |
|---|---|---|
| 858728 | 12/1940 | France . |
| 2390179 | 5/1977 | France . |

*Primary Examiner*—Richard J. Apley
*Assistant Examiner*—K. D'Arrigo
*Attorney, Agent, or Firm*—Seidel, Gonda & Goldhammer

[57] ABSTRACT

An exercise machine including a set of pedals which are rotatable by the user, and a crib for supporting the user in the supine position. The crib and pedals oscillate simultaneously in opposite directions under motive power of the pedals.

11 Claims, 11 Drawing Figures

FIG. 5
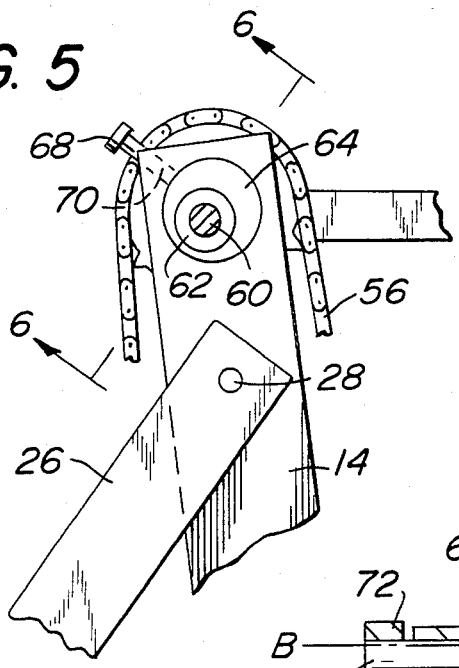
FIG. 6
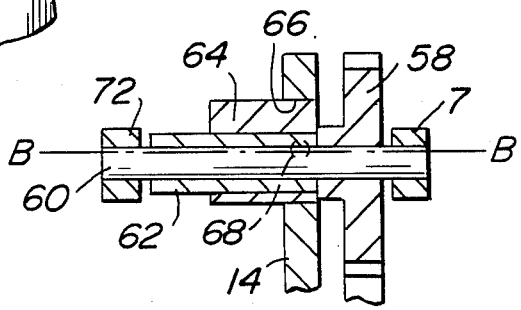
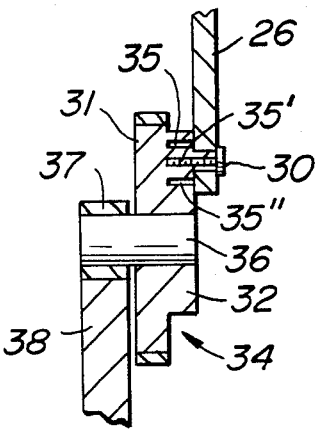
FIG. 7
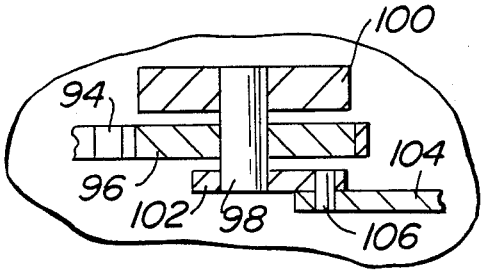
FIG. 8

EXERCISE MACHINE

BACKGROUND OF THE INVENTION

Exercise machines wherein pedals are used as the motive power for other elements of the machine are known. For example, in U.S. Pat. No. 3,112,108 (Hanke) an exercise machine is disclosed wherein a set of foot pedals is connected to discs which are linked to associated hand levers. Rotation of the foot pedals causes oscillation of the hand levers over a prescribed arc so as to exercise the user's arms. Conversely, oscillation of the hand levers produces rotation of the foot pedals so as to exercise the user's legs.

Exercise machines including a moveable support for the user are also known. For example, in U.S. Pat. No. 3,189,344 (Swarts) there is disclosed an exercise machine wherein the user rotates a set of pedals with his legs while rocking himself back and forth. In addition, the machine frame assembly may be pivoted by pulling the assembly towards the user, thereby causing the seat to slide backward, in the same direction of travel as the frame assembly. For this use of the machine, the user's feet must apparently be planted on the floor. Similarly, in U.S. Pat. No. 2,512,911 (Benice) there is disclosed a rower exerciser wherein a seat is roller-mounted on spaced tracks so as to be reciprocable along the tracks. The seat is moveable in response to the user's pulling on a handle and then pushing with his legs against a set of pedestals.

It is also known to mount the pedals of an exercise machine so as to provide an adjustment for the position of the pedals. For example in U.S. Pat. No. 2,673,088 (Wentz) there is disclosed an exercise machine wherein the pedals are mounted on a swingable leg so as to enable the operator to vary the position of the pedals with respect to his body.

None of the machines of the prior art provide a means of simultaneously exercising the legs and trunk of the user utilizing a set of bicycle pedals. None of the machines provides a simple mechanism for oscillating a set of pedals and a crib for supporting the user in synchronism under motive power of the pedals alone. Accordingly, it is an object of the invention to provide an exercise machine which simultaneously exercises the trunk and legs of the user. In particular, it is an object of the invention to provide such a machine wherein the trunk and legs of the user are exercised simultaneously under motive power of the bicycle pedals. A further object of the invention is to provide an exercise machine wherein the arms and trunk of the user may be exercised simultaneously, again under motive power of the pedals alone.

BRIEF SUMMARY OF THE INVENTION

Exercise machine for simultaneously exercising the user's trunk and the user's legs comprising a set of pedals mounted for rotation about an axis, a crib mounted for oscillating movement along a linear path, means coupled to the pedals for causing oscillating movement of the pedals along a prescribed arc in response to rotation of the pedals about said axis, and means for causing oscillating movement of the crib along the linear path in synchronism with said oscillating movement of the pedals along said prescribed arc.

For the purpose of illustrating the invention, there is shown in the drawings a form which is presently preferred; it being understood, however, that this invention is not limited to the precise arrangements and instrumentalities shown.

BRIEF DESCRIPTION OF THE DRAWINGS

FIG. 5 is an enlarged section taken 5—5 in FIG. 1.

FIG. 6 is a section taken along 6—6 in FIG. 5.

FIG. 7 is a section taken along 7—7 in FIG. 3.

FIG. 8 is a section taken along 8—8 in FIG 2.

DETAILS DESCRIPTION OF THE INVENTION

Figure 1:
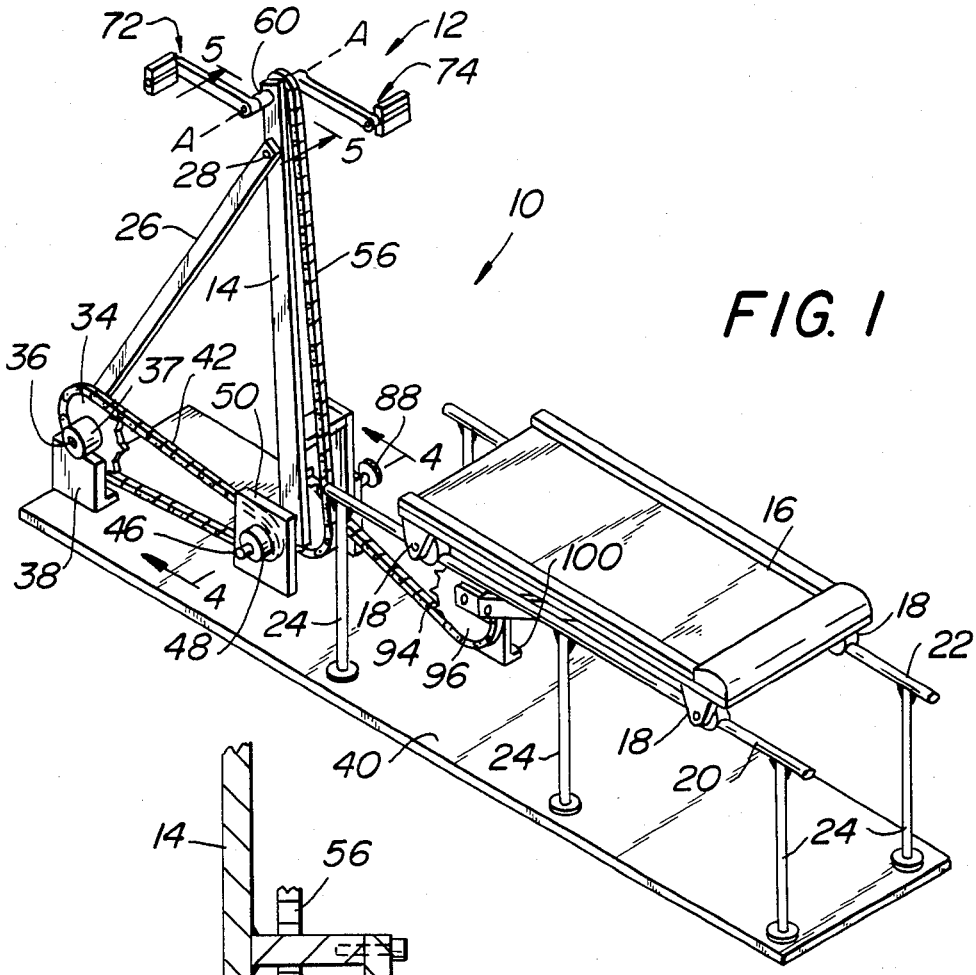
FIG. 1 is a perspective of the exercise machine of the present invention.

Referring to the drawings wherein like numerals like elements, there is shown in FIG. 1 the exercise machine of the present invention designated generally as 10. The exercise machine includes a conventional bicycle pedal assembly 12 comprising pedal crankarms 72, 74 secured to a pedal shaft 60 mounted for rotation about a longitudinal axis A—A on a link 14. Each pedal crank arm is provided with a pedal (not numbered) in conventional fashion. The exercise machine 10 also includes a crib 16 provided with a set of four roller assemblies, each designated as 18, secured to the underside of the crib. Each roller assembly includes a clevis secured to the underside of the crib and a roller mounted on the clevis. The rollers are mounted on spaced parallel rails 20, 22 which are supported by standards 24 secured to a base 40.

Figure 2:
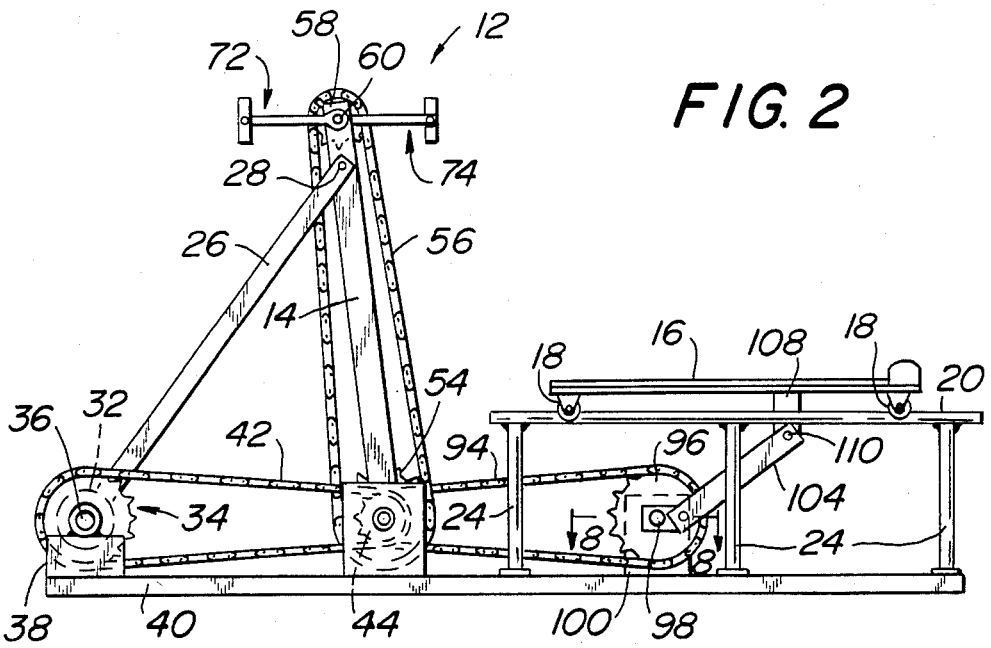
FIG. 2 is a front elevation of the machine shown in FIG. 1.

Referring to FIG. 2, link 14 is pivotably coupled near one end to a link 26 by means of a pivot pin 28. The other end of link 26 is pivotably coupled by means of a pivot pin 30 to an arm 31 extending from the hub portion 32 of a sprocket wheel 34. See FIG. 3 and 7. The sprocket wheel 34 is secured to a shaft 36 journaled in a bearing 37 mounted on an upstanding support 38 which is secured to the machine base 40. Rotation of the sprocket wheel 34 under motive power of the pedal assembly 12 causes oscillating movement of the link 26 and a correlated oscillating movement of the link 14 as explained more fully hereinafter.

The sprocket wheel 34 is coupled by means of a chain 42 to a sprocket wheel 44 secured to a shaft 46. The shaft 46 is journaled at one end in a bearing 48 mounted on an upstanding support 50 and is journaled at its other end in upstanding support 52 and a drag brake assembly 76. See FIG. 4. Supports 50 and 52 are secured to the machine base 40.

A sprocket wheel 54 is also secured to shaft 46 and is coupled by chain 56 to a sprocket wheel 58 which is secured to pedal shaft 60. See FIGS. 2–4. Rotation of the pedal sprocket wheel 58 therefor causes corresponding rotation of sprocket wheels 54 and 44 on shaft 46. As a result, sprocket wheel 34 is rotated together with shaft 36, causing oscillating movement of the link 26.

To adjust the tension on chain 56 so as to keep the chain on sprocket wheels 54, 58, the pedal shaft 60 is journaled in a bearing sleeve 62 eccentrically mounted in and secured to a bushing 64. See FIGS. 5 and 6. The bushing 64 is rotatable (for purposes of adjustment only) within an opening 66 in link 14. The bushing 64 may be rotated by grasping the bushing with a tool or by hand and by urging the bushing clockwise or counter clockwise with respect to the bushing central axis B—B so as to change the distance between shaft 60 and shaft 46 (FIG. 1), thereby increasing or decreasing the tension on chain 56 as desired. The bushing may then be fixed in position by advancing a screw 68 in a threaded bore link 70 in link 14 so as to tighten the screw against the outer surface of the bushing.

The link 14 is freely mounted for rotation about shaft 46. See FIG. 4. Movement of the link 26 due to rotation of sprocket wheel 34 under motive power of the pedal assembly therefore produces an oscillating movement of link 14 over a prescribed arc with respect to the longitudinal axis of shaft 46. As a result, the pedal assembly 12 moves back and forth over a prescribed arc as the pedal crank arms 72, 74 are rotated by the user about the axis A—A of pedal shaft 60.

Figure 4:
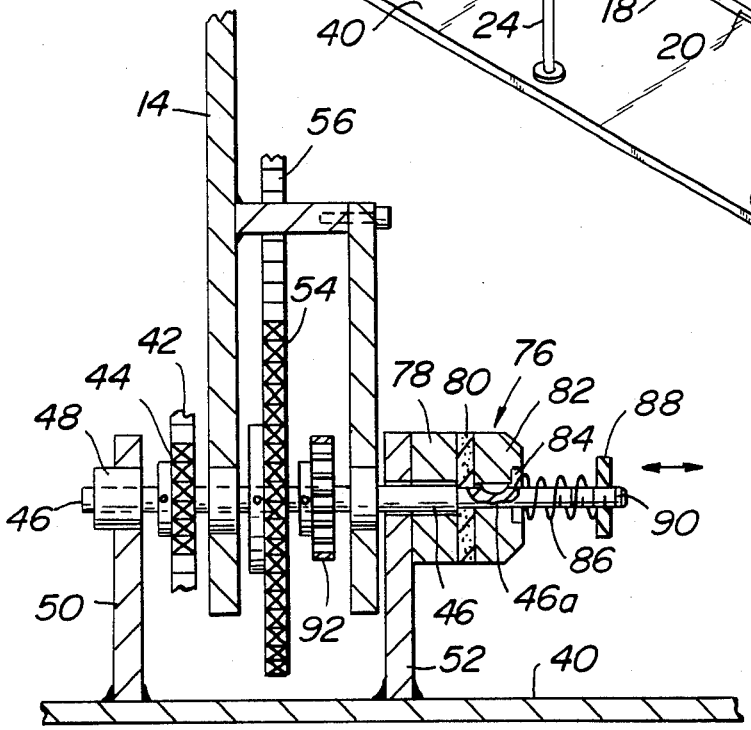
FIG. 4 is a partial section taken along 4—4 in FIG. 1.

The drag brake assembly 76 is provided to adjust the force required to rotate the pedal crank arms 72, 74. See FIG. 4. The drag brake assembly 76 includes a cylindrical section 78 secured to support 52. The shaft 46 is journaled in a central opening in section 78. The shaft 46 is provided with a reduced diameter portion **46*a* which extends through a central opening in a disc-shaped resilient pad 80. Once face of pad 80 contacts brake assembly section 78 and the other face of the pad contacts a generally cylindrical rotary end section 82. The shaft portion 46*a* is keyed to the end section 82 as shown in FIG. 4 so that the end section and shaft 46 rotate together. The end section 82 is provided with a recess 84 which accommodates a spring 86. The spring 86 may be compressed by advancing a threaded washer 88 to the left in FIG. 4 along a threaded portion 90 of shaft portion 46*a*. Compression of spring 86 results in increased frictional contact between section 82 and pad 80. Advancing the washer 88 to the right on shaft portion 46*a* reduces the compression of spring 86, thereby reducing the frictional contact between end section 82 and pad 80**.

Figure 3:
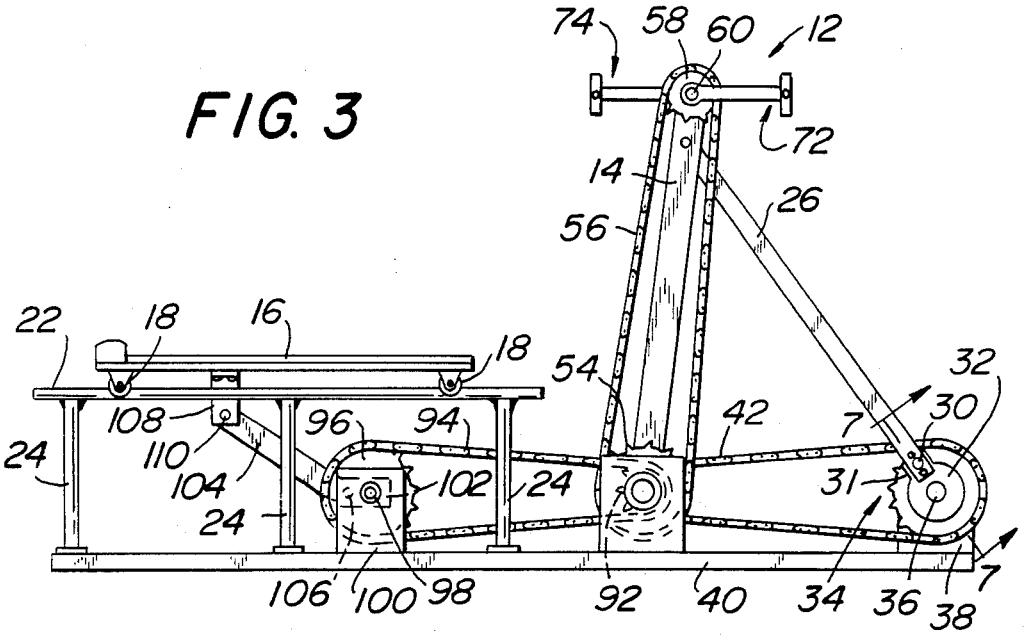
FIG. 3 is a rear elevation of the machine shown in FIG. 1.

A sprocket wheel 92 is also secured to shaft 46 for rotation therewith and is coupled by means of a chain 94 to a sprocket wheel 96 situated below crib 16. See FIGS. 2–3. The sprocket wheel 96 is secured to a shaft 98 journaled in an upstanding support 100 mounted on base 40. See FIGS. 3 and 8. A crank arm 102 is also secured to shaft 98, and a link 104 is pivotably coupled at one end to the crank arm by means of a pivot pin 106 (FIG. 8). The other end of the link 104 is pivotably coupled to a bracket 108 by means of pivot pin 110 (FIG. 3). The bracket 108 is secured to the underside of crib 16. Rotation of sprocket wheel 96 therefore produces an oscillating movement of link 104 and a corresponding linear oscillating movement of crib 16 on rails 20 and 22.

Figure 9:
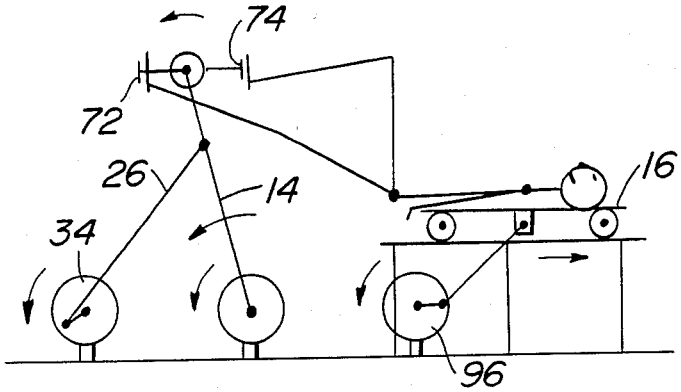
FIGS. 9–11 are diagrammatic representations of the oscillating movement of the pedals and crib under motive power of the pedals alone.
Figure 10:
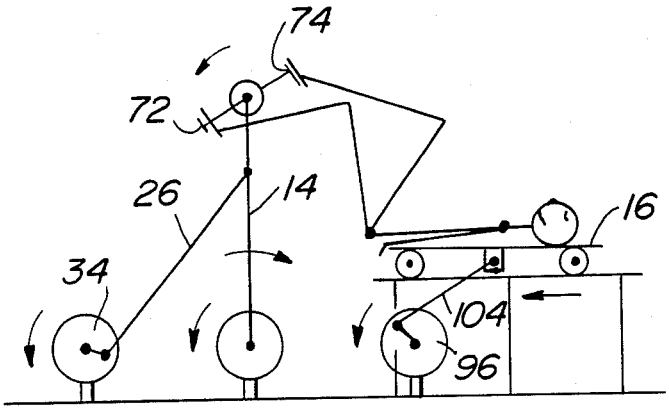
Figure 11:
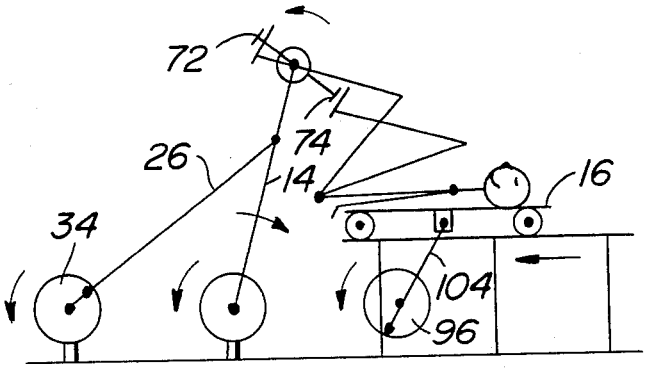

Operation of the exercise machine can best be observed by reference to FIGS. 9–11. The user assumes the supline position with his back resting on the crib 16 and his legs pushing against the pedals so as to rotate pedal crank arms 72, 74. As the pedal crank arms 72, 74 are rotated counter-clockwise (CCW), link 14 is pivoted CCW by link 26, and the pedal crankarms 72, 74 are moved over a prescribed arc away from the user, thereby requiring extension of the user's legs and trunk muscles. At the same time, link 104 causes linear movement of crib 16 towards the right (FIG. 9), requiring further extension of the user's legs and trunk muscles. As the user continues to rotate pedals 72, 74 CCW, the direction of rotation of link 14 reverses and the link moves CW, thereby moving pedal crank arms 72, 74 towards the user, i.e., to the right in FIG. 10. The user must retract his legs towards his trunk, retracting his trunk muscles, to continue to operate the pedals. At the same time, the direction of travel of crib 16 reverses so that the crib now travels towards the pedals, i.e., the left (FIG. 10). As the user continues to rotate the pedal crank arms 72, 74 CCW, link 14 reaches an extreme displacement position as shown in FIG. 11 with the pedal crank arms 72, 74 being brought closest to the user. At the same time, the link 104 reaches an extreme position of displacement, bringing crib 16 closest to the pedal crank arms. For these positions of links 14 and 104, the user must retract his legs and trunk muscles to an extreme so as to continue to operate the pedal crank arms. Thereafter, the direction of displacement of links 14 and 104 reverses as the user continues to rotate the pedals CCW, and the pedal crank arms and crib 16 again move away from each other as shown in FIG. 9. The foregoing oscillating movements of the pedal crank arms and crib, towards each other and then away from each other, are repeated as the pedal crank arms are rotated by the user.

It should be appreciated that the invention enables simultaneous oscillating movement of the pedal crank arms over a prescribed arc and the crib over a linear path in opposite directions so as to exercise both the legs and trunk muscles of the user. If desired, the range of motion of the link 14 may be adjusted relative to the user by providing plural pivot positions for the link 26 along link 14. Alternatively, as shown in FIG. 7, plural pivot positions for the link 26 may be provided at hub arm 31. Thus, the hub arm may be provided with plural threaded slots 35, 35′ and 35″ within which pivot pin 30 may be secured.

It should also be evident that various modifications may be made to the embodiment described herein without exceeding the spirit and scope of the invention. For example, the threaded washer 88 may be replaced by a lever which is threadedly fastened to the threaded portion 90 of shaft **46*a*. The lever would be accessible to the user's arm so that the drag brake assembly 76** could be adjusted to increase or decrease the force required to rotate the pedal crank arms as previously described while the exercise machine is being used.

The present invention may be embodied in other specific forms without departing from the spirit or essential attributes thereof and, accordingly, reference should be made to the appended claims, rather than to the foregoing specification, as indicating the scope of the invention.

I claim:

1. An exercise machine, comprising:

pedal means mounted for rotation about a longitudinal axis, crib means for supporting a user and mounted for oscillating motion along a linear path, means coupled to said pedal means for causing oscillating movement of said pedal assembly along a prescribed arc in response to rotation of said pedal assembly about said longitudinal axis, and means for causing oscillating movement of said crib means along said linear path in synchronism with said oscillating movement of said pedal assembly along said prescribed arc.

2. Exercise machine according to claim 1 wherein said pedal means includes a set of pedal crank arms rotatably mounted on a shaft and wherein said means coupled to said pedal means includes a first link pivotably mounted on said shaft and a second link pivotably coupled to said first link, and means for displacing said second link so as to produce said oscillating movement of said pedal means along said prescribed arc in response to rotation of said pedal crank arms.

3. Exercise machine according to claim 1 wherein said means for causing oscillating movement of said crib means includes a link pivotably coupled to said crib and means for displacing said link so as to produce said oscillating movement of said crib in response to rotation of said pedal means.

4. Exercise machine according to claim 1 wherein said oscillating movement of said pedal means and said oscillating movement of said crib means are in opposed directions.

5. Exercise machine, comprising:

pedal means mounted for rotation on a shaft, a first link pivotably coupled to said shaft, a second link pivotably coupled to said first link, means for displacing said second link so as to produce oscillating movement of said first link over a prescribed arc in response to rotation of said pedal means about said shaft, a crib mounted for oscillating movement along a linear path, a third link pivotably coupled to said crib, and means for displacing said third link so as to produce oscillating movement of said crib along said linear path in synchronism with said oscillating movement of said first link.

6. Exercise machine according to claim 5 wherein said oscillating movement of said first link and said oscillating movement of said crib occur in opposed directions.

7. Exercise machine according to claim 5 wherein said means for displacing said second link includes a chain and sprocket wheel transmission operatively associated with said pedal means.

8. Exercise machine according to claim 5 wherein said means for displacing said third link includes a chain and sprocket wheel transmission operatively associated with said pedal means.

9. Exercise machine according to claims 7 or 8 including means for adjusting the position of said shaft so as to alter the tension of said chain and sprocket wheel transmission.

10. Exercise machine according to claims 7 or 8 including means for adjustably braking said chain and sprocket wheel transmission.

11. Exercise machine according to claim 10 wherein said means for adjustably braking said chain and sprocket wheel transmission comprises a spring-operated drag brake assembly.

* * * * *